US007823857B2

(12) United States Patent
Stengel et al.

(10) Patent No.: US 7,823,857 B2
(45) Date of Patent: Nov. 2, 2010

(54) COLLAPSIBLE EASEL

(75) Inventors: Michael John Stengel, Town and Country, MO (US); Trung Q Do, Bridgeton, MO (US)

(73) Assignee: Swank Audio Visuals LLC, St. Louis, MO (US)

( * ) Notice: Subject to any disclaimer, the term of this patent is extended or adjusted under 35 U.S.C. 154(b) by 223 days.

(21) Appl. No.: 11/943,439

(22) Filed: Nov. 20, 2007

(65) Prior Publication Data

US 2008/0116347 A1 May 22, 2008

Related U.S. Application Data

(60) Provisional application No. 60/866,958, filed on Nov. 22, 2006.

(51) Int. Cl.

| | |
|---|---|
| ***A47B 97/04*** | (2006.01) |
| ***A47B 97/06*** | (2006.01) |
| ***A47G 23/02*** | (2006.01) |
| ***A47F 5/00*** | (2006.01) |
| ***A47F 7/00*** | (2006.01) |
| ***F16M 11/00*** | (2006.01) |
| ***F16M 13/00*** | (2006.01) |
| ***B60B 11/10*** | (2006.01) |

(52) U.S. Cl. ..... 248/450; 248/460; 248/463; 248/464; 248/462; 248/150; 248/465; 248/122.1; 248/125.1; 248/447; 248/447.2; 280/767

(58) Field of Classification Search ..... 248/460, 248/463, 464, 462, 122.1, 125.1, 163.1, 165, 248/166, 159, 150, 155, 292.13, 316.2, 528, 248/441.31, 447, 447.2, 455, 456, 457, 465, 248/465.1, 168, 437, 169, 171, 188.5, 246; 280/767, 47.24

See application file for complete search history.

(56) References Cited

U.S. PATENT DOCUMENTS 294,941 A * 3/1884 Werner ..... 248/463
4,017,049 A * 4/1977 Albee, Jr. ..... 248/464

(Continued)

*Primary Examiner*—J. Allen Shriver, II
*Assistant Examiner*—Christopher Garft
(74) *Attorney, Agent, or Firm*—Howard B. Rockman

(57) ABSTRACT

A collapsible easel for holding items to be displayed, the easel having a top assembly and a base assembly. The base assembly includes two front legs and a rear leg, each leg pivotally mounted to the top assembly with cushion members forcing part of the top assembly to provide a slight restriction against pivoted movement of the two front legs. A V-shaped spring assembly is pivotally mounted on the rear leg, and is removably attached to each front leg. Insertion of portions of the spring assembly into apertures in the front legs, allows the easel to stand in a tripod configuration. Removal of portions of the V-shaped spring assembly from the apertures in the front legs allows the legs to be folded together. In another embodiment, a collapsible brace assembly connects the rear leg to the front legs. The collapsible brace assembly comprises a pair of lateral struts extending between and engaging each of the front legs and a bracket connecting the lateral struts. The bracket of the brace assembly further engages a rear extension assembly which extends to and is pivotally connected to the rear leg. The dimensions of the lateral struts and the rear extension assembly are determined by a first open tripod position and a second closed position of the easel such that the easel may be folded flat for easy transportation and storage.

12 Claims, 9 Drawing Sheets

U.S. PATENT DOCUMENTS 4,171,116 A * 10/1979 Carver et al. ..... 248/464
4,502,654 A * 3/1985 Albee, Jr. ..... 248/168
5,125,613 A * 6/1992 Albee et al. ..... 248/464
5,746,406 A * 5/1998 Dicke et al. ..... 248/166
6,135,413 A * 10/2000 Glebe ..... 248/441.1
6,202,974 B1 * 3/2001 Rellinger ..... 248/460
6,601,805 B1 * 8/2003 Kapp ..... 248/171
6,719,259 B2 * 4/2004 Huang et al. ..... 248/441.1
7,207,532 B1 * 4/2007 Roberts et al. ..... 248/125.1
2005/0258328 A1 * 11/2005 Weder ..... 248/463
2006/0226309 A1 * 10/2006 Pao ..... 248/122.1

* cited by examiner

COLLAPSIBLE EASEL

CROSS REFERENCE TO RELATED APPLICATIONS

This application claims priority from provisional application No. 60/866,958 filed on Nov. 22, 2006 to the extent allowed by law.

FIELD OF INVENTION

The present invention is directed toward an easel, more specifically a collapsible easel for holding objects of varying sizes, such as display panels, canvases, flip charts, sketchbooks and like items to be displayed.

BACKGROUND OF THE INVENTION

Easels of tripod style have been available for many years for displaying panels and canvases, flip charts, sketchbooks and the like. A conventional tripod easel usually comprises an apex, three legs pivotally connected to the apex and at least one supporting member for holding objects for display mounted on the easel. Most easels use rigid metal braces that permanently lock the legs in place. However, designs that permanently lock the easel legs in place make the storage and transportation of such easels difficult and costly. In addition, all easels in the prior art fail to provide a durable design to reduce friction and wear resulting from pivotal movement of the legs contacting the apex, especially when the legs and the apex are made of materials such as powder-coated metal.

U.S. Pat. No. 6,135,413 to Glebe is directed to a collapsible easel having a plurality of legs pivotally joined together by a head. V-shaped rigid bracing elements are provided with receptacle portions receivable at the rear leg and end projections for pivotally mounting the bracing element in predrilled openings in the side edges of the front legs. The receptacle portion is generally rectangular-shaped, thereby defining a cavity or receptacle within which the rear leg is slidably received. Clearly, the design of the reference patent only works on legs having a square tube shape, and not on round or any other closed geometric shaped tubes. The design of the reference patent only permits a fixed extension position or angle, since the receptacle portion must rest at the top of the lower portion of the rear leg. When the rear leg is being folded or extended, damage to paint or powder-coating on the rear leg of the reference easel is likely to occur due to relative movement of the receptacle portion on the top of the lower portion of the rear leg. Finally, the amount of grip provided by the support braces of the reference easel will largely depend on the opening angle formed by the two front legs and the rear leg. If the front legs were to move or flex away from each other or the rear leg, the support brace would then spread further apart in response, which would decrease the amount of grip the support brace can generate against the rear leg.

U.S. Pat. No. 6,202,974 to Rellinger discloses a portable easel with an adjustable board support comprising a plurality of legs joined together by a head. The design of the reference easel does not include a brace assembly for the legs to enable a stable locked position of the legs while the easel in use and to provide a mechanism for collapsing the easel for easy transportation and storage.

None of the previous easels in the field comprise a removable support brace that provides an easy-to-use and stable design for various types of easels made of leg tubing, and that can be adapted to allow an operator to tilt the easel at various angles while in use. Also, no prior easel includes a cushioning mechanism in the areas where the legs contact the apex to reduce friction and wear resulting from pivotal movement of the legs abutting the apex, especially when the legs and the apex are made of materials such as powder-coated metal.

Thus, it is a primary objective of this invention to provide a collapsible easel that is stable, durable and adjustable.

It is a further objective of the present invention to provide a collapsible easel for holding display panels, canvases, sketchbooks, flip charts and like objects of varying sizes.

Another objective of the present invention is to provide an easel that is easy to assemble with quick and intuitive operations.

It is another objective of the present invention to provide additional support to stabilize the easel so that the legs of the easel will not move relative to each other when the easel is in use, or when the legs move into or from a collapsed position.

An additional objective of the present invention is to provide an aesthetically pleasing design of an easel.

A further objective of the present invention is to provide a mechanism to reduce friction and wear resulting from use of the easel.

SUMMARY OF THE INVENTION

In one embodiment of the invention, a collapsible easel having a top assembly and a base is provided. The base includes two front legs and a rear leg, each leg pivotally attached to the top assembly. At least one pair of opposed foldable brackets is pivotally attached to each front leg, the brackets adapted to support display panels, canvases, sketchbooks, flip charts or the like for display purposes. A brace or spring assembly, comprising a V-shaped spring and connecting the rear leg to each of the front legs, is provided to stabilize the easel when the easel is in use. The top assembly includes a front support and a connector assembly. The front support provides support for display panels, canvases, sketchbooks, flip charts, or the like mounted on the opposed brackets. The connector assembly pivotally connects the base to the top assembly, and includes cushion elements placed between the top assembly and the legs of the base to reduce friction and wear resulting from pivotal movement of the legs contacting the top assembly. In another embodiment, a collapsible brace assembly connects the rear leg to the front legs. The collapsible brace assembly comprises a pair of lateral struts extending between and engaging each of the front legs and a bracket connecting the lateral struts. The bracket of the brace assembly further engages a rear extension assembly which extends to and is pivotally connected to the rear leg. The dimensions of the lateral struts and the rear extension assembly are determined by a first open tripod position and a second closed position of the easel such that the easel may be folded flat for easy transportation and storage.

In accordance with these and other objectives that will become apparent hereafter, the present invention will be described with particular reference to the accompanying drawings.

BRIEF DESCRIPTION OF THE DRAWINGS

FIG. 1 is a front/side perspective view of an embodiment of a collapsible easel in accordance with the present invention, with the easel shown in a tripod configuration and the bracket members shown in an outwardly extended position ready to hold a display panel or the like;

DETAILED DESCRIPTION OF THE INVENTION

Figure 1:
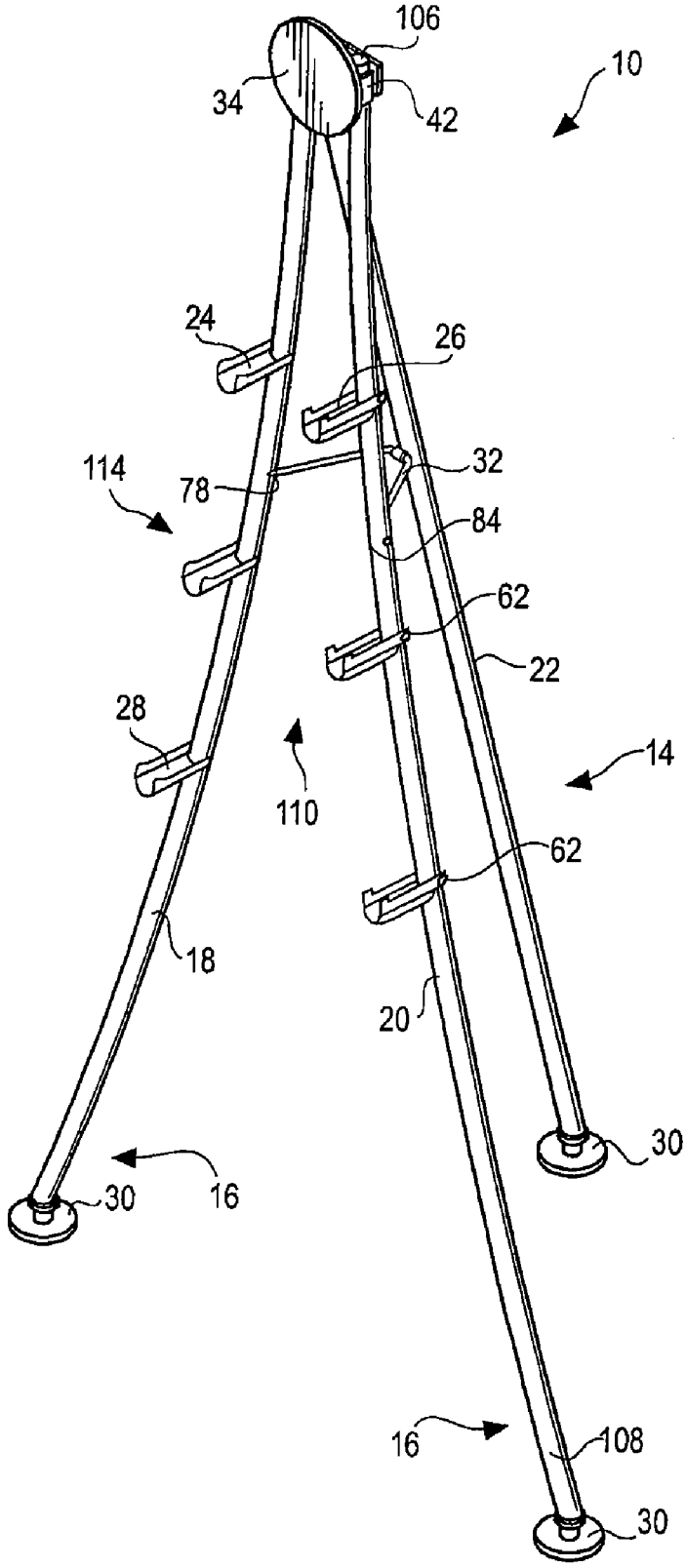

FIG. 1 illustrates an embodiment of a collapsible easel 10 for holding display panels, canvases, sketchbooks, flip charts or the like. The easel 10 comprises a top assembly 12 and a base 14. The base 14 includes a front leg assembly 16 and a rear leg 22, the front leg assembly comprising a first front leg 18 and a second front leg 20. Both of the front legs 18, 20 and the rear leg 22 are pivotally attached to top assembly 12, as will be described.

To provide an easel design having both an aesthetic appeal and additional stability, each of the front legs 18, 20 curve slightly toward bottom end 108, as seen in FIG. 1. However, one of ordinary skill in the art will appreciate that the disclosed invention is not limited to what is shown in the drawings and straight legs can be substituted for legs 18, 20. Also, tubing forming the legs 18, 20, 22 in the illustrated embodiment is not limited to the round design shown in FIGS. 1-3, and any closed geometric shapes such as squares, triangles, rectangles, or other suitable shapes can be used for the tubing of the legs 18, 20, 22.

Figure 6:
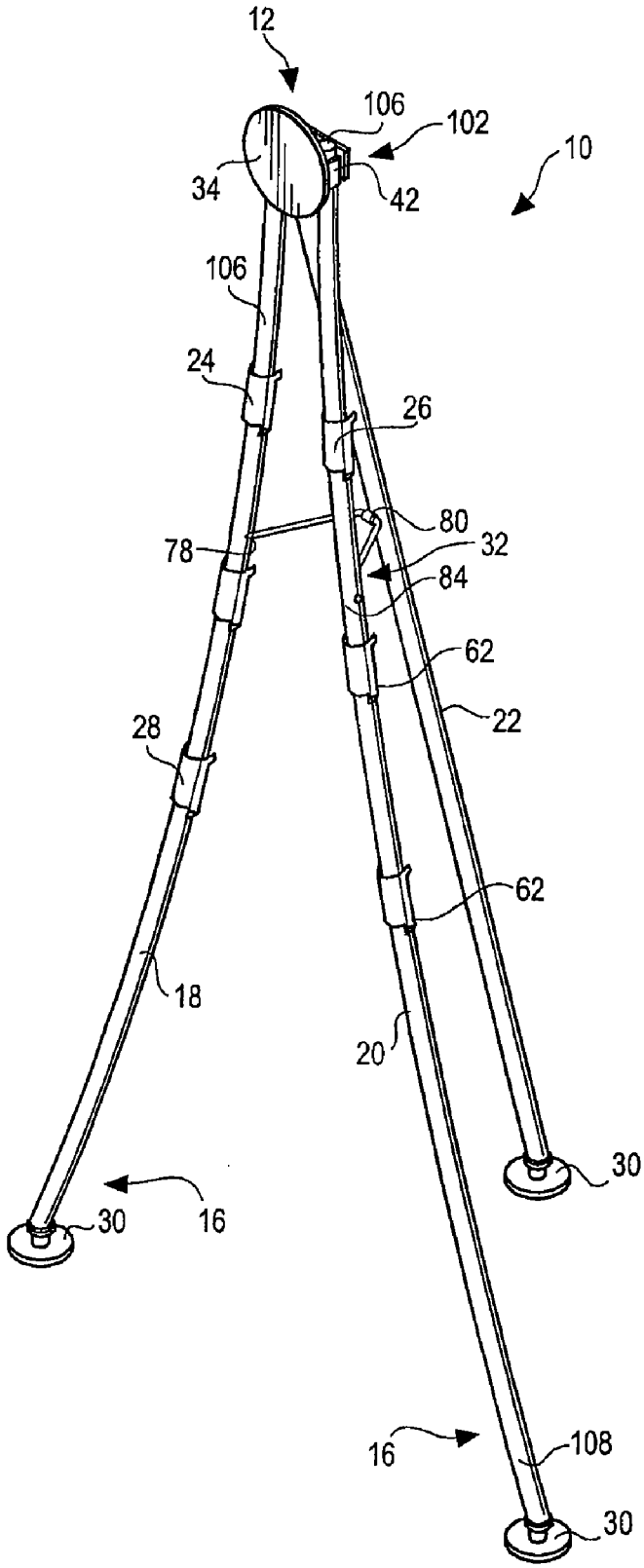
FIG. 6 is a front/side perspective view of the embodiment of the collapsible easel of FIG. 1, with the easel shown in a tripod configuration and the bracket members shown in an upwardly folded position.

Each of the legs 18, 20, 22 in the illustrated embodiment of FIGS. 1, 6 is provided with a footing 30, which is attached through conventional means to the bottom end 108 of each of the legs 18, 20, 22 for safety and stability considerations.

As seen in FIG. 1, in one position of the easel 10, legs 18, 20 and 22 are extended outward from each other to form a triangle, or tripod, with footings 30 contacting the surface supporting easel 10, thus allowing easel 10 to stand in a tripod configuration designated 110. To collapse the easel 10 to the position shown in FIG. 7, legs 18, 20 and 22 are each pivotally moved towards each other and folded adjacent one another to a folded configuration designated 112 (FIG. 7), allowing for easy transportation and storage of the easel 10.

Figure 4:
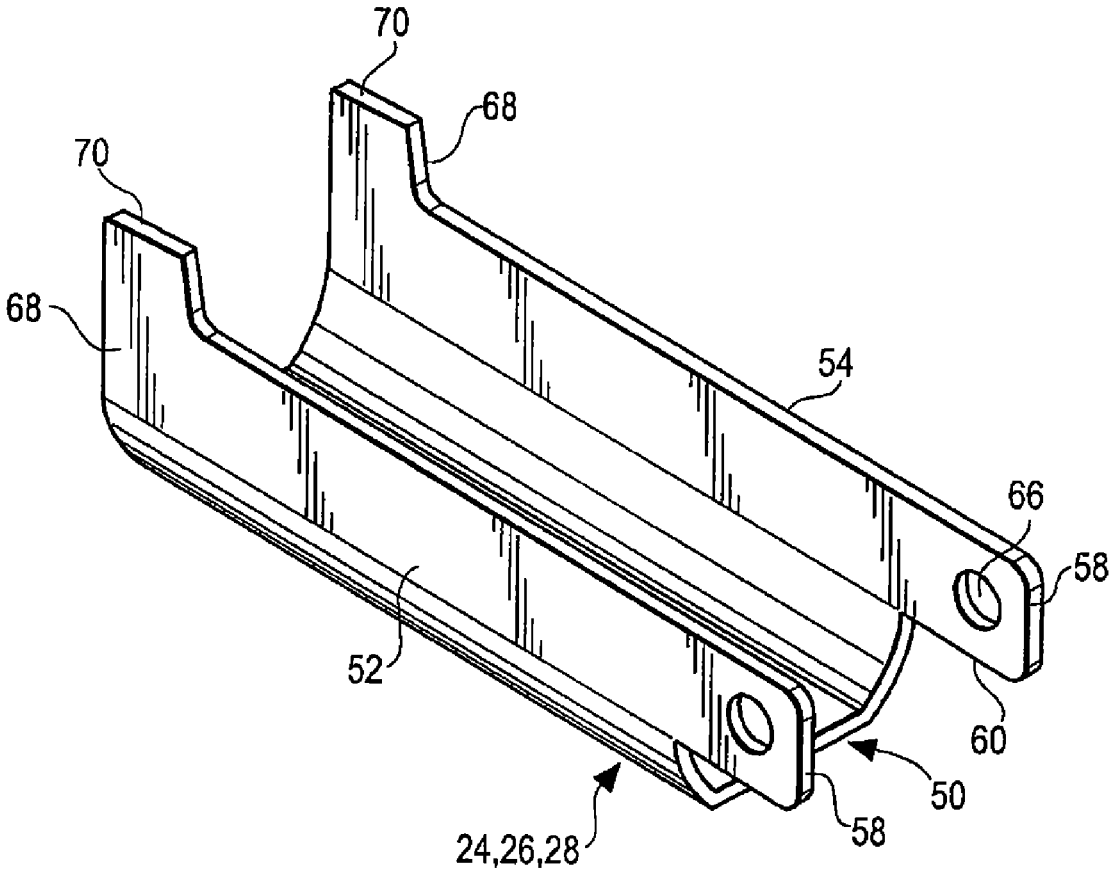
FIG. 4 is a side detail perspective view of one of the bracket members of the collapsible easel of FIG. 1.

As seen in FIGS. 1, 4 and 6, each of the front legs 18, 20 is provided with a plurality of pivotally attached bracket members 24, 26 and 28. Bach bracket member has a first position where the bracket member extends outwardly from the front leg assembly to support items to be displayed, and a second substantially vertical position where the bracket member engages and fits partially around the contour of the corresponding front leg assembly. Each bracket member 24, 26, 28 has a bottom portion 50 (FIG. 4) that is hollow, and in the illustrated embodiment, has a half cylindrical shape so that when the bracket member 24, 26, 28 folds up in the second position, the bottom portion 50 will fit over the contour of the leg 18, 20 to which the bracket member 28 is attached. Each bracket member 24, 26, 28 further includes two side portions 52, 54 extending upward from the bottom portion 50. Side portions 52, 54 each have a first end 58 and a second end 68. The first end 58 includes a longitudinal or axial extension 60 with an aperture 66 adapted to receive a rivet or a bolt 62 (FIG. 1). The second end 68 has a radially extending flange 70 providing a vertical extension adapted to assist in holding items supported by the easel 10. When the bracket member 24, 26, 28 folds up in the second position, flange 70 extends partially over the leg to which the bracket member 24, 26, 28 is attached, thereby securing the bracket member 24, 26, 28 onto the contour of the corresponding leg (FIG. 6). When the easel 10 is in use, each bracket member 24, 26, 28 can be pivoted to the first outward position 114 (FIG. 1), allowing display panels, canvases, flip charts, sketchbooks, or the like to be held in place inside of flanges 70 of the bracket members 24, 26, 28, and supported by the upper extent of side portions 52, 54 of each bracket.

As seen in FIG. 1, pairs of bracket members 24, 26, 28 are located at a certain vertical level on each of the legs 18, 20, wherein each bracket member 24, 26, 28 is in horizontal alignment with an opposing bracket member. The pairs of aligned brackets 24, 26, 28 are used in tandem to hold display panels, canvases, sketchbooks, flip charts or the like placed inside the flanges 70 of the pairs of aligned brackets.

The number of brackets selected to be pivotally mounted on each of the front legs 18, 20 is not limited to those shown in the drawings and preferably is chosen to allow items of varying sizes to be supported on and displayed by the easel 10.

Figure 5:
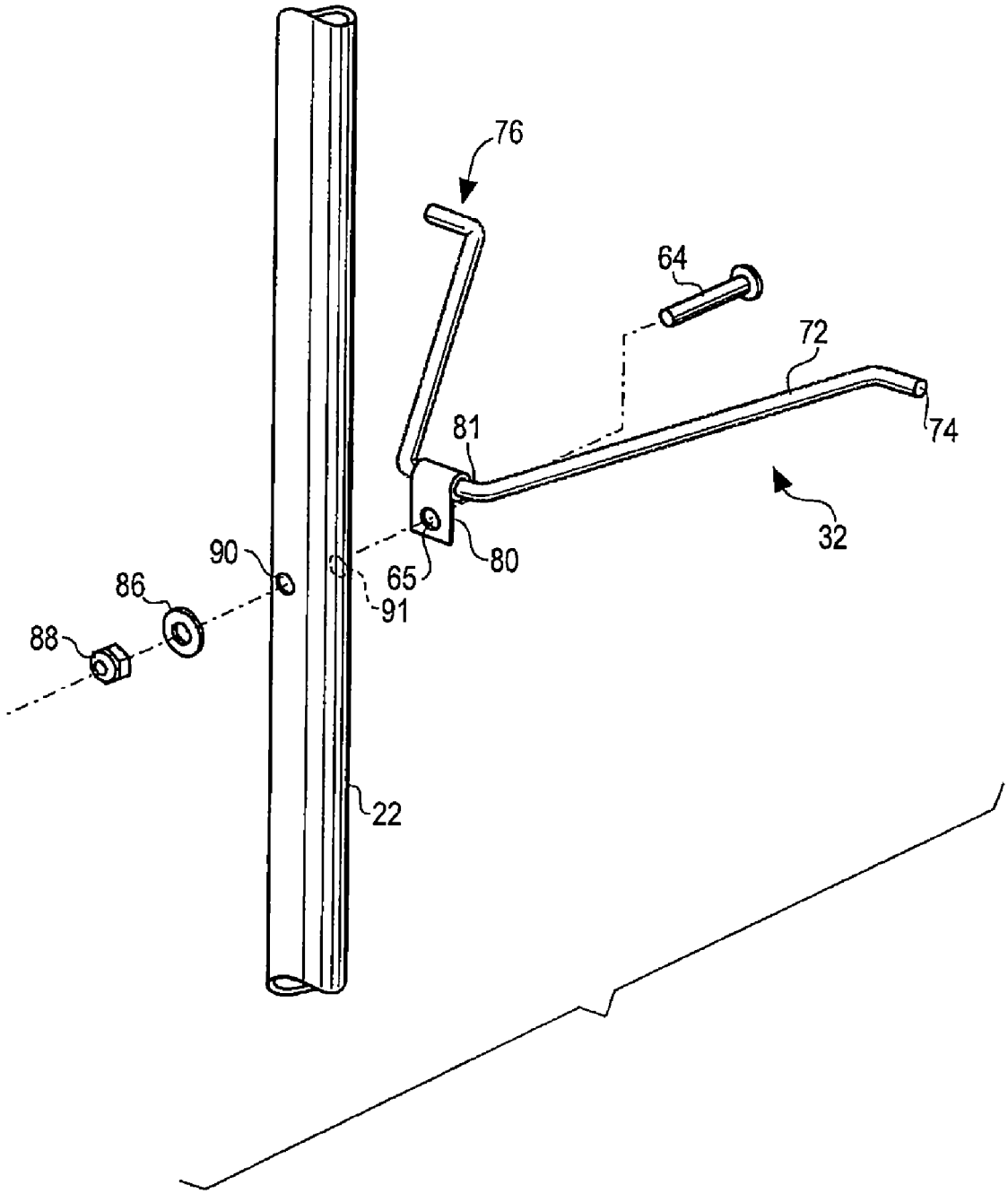
FIG. 5 is a side detail exploded view of a V-shaped spring assembly of the embodiment of the collapsible easel shown in FIG. 1.

As seen in FIGS. 1 and 5, a brace or spring assembly 32 comprises a V-shaped spring 72 having two ends 74, 76 extending horizontally such that first end 74 is removably received in a first aperture 78 in the first front leg 18, and second end 76 is removably received in a second aperture 84 in the second front leg 20. The spring assembly 32 further includes a mounting or attachment bracket 80 pivotally attached to the bottom center portion 81 of the V-shaped spring 72. Opposed apertures 90 and 91 are also provided at the rear leg 22 to receive bolt 64 that extends through aperture 65 in bracket 80. Bolt 64 is fastened through aperture 90 to rear leg 22 through mechanisms well known in the art, such as washer 86 and nut 88, to securely mount bracket 80 to rear leg 22.

Figure 7:
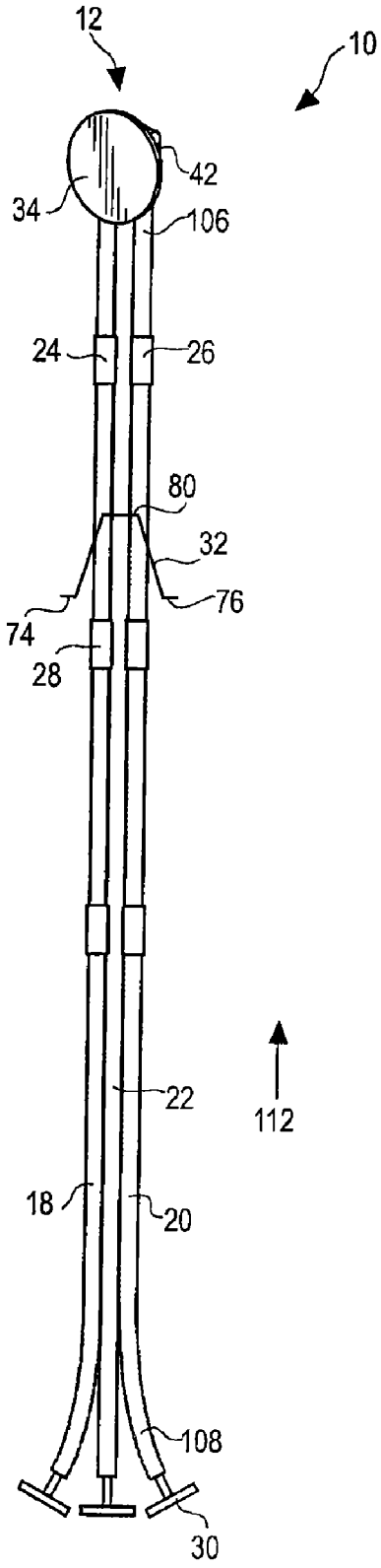
FIG. 7 is a front perspective view of the embodiment of the collapsible easel shown in FIG. 1, with the easel shown in a folded configuration and the bracket members shown in an upwardly folded position.

Spring assembly 32 (FIG. 1) provides stable positioning of the easel 10 by securely and removably fastening the rear leg 22 to the two front legs 18, 20 so that legs 18, 20, 22 will be immobile relative to each other when the easel 10 is in use in its tripod position. After use, spring assembly ends 74, 76 are withdrawn from apertures 78 and 84 and each of the legs 18, 20, 22 pivot with a light drag toward each other, allowing the easel 10 to be easily collapsed to the folded configuration 112 (FIG. 7).

Although in the drawings only one pair of apertures 78, 84 for each of the legs 18, is shown to receive spring assembly 32, the number and position of apertures 78, 84 is not limited to what is shown in the drawings and can be chosen to allow the user to tilt the easel 10 at various desired angles.

Figure 2:
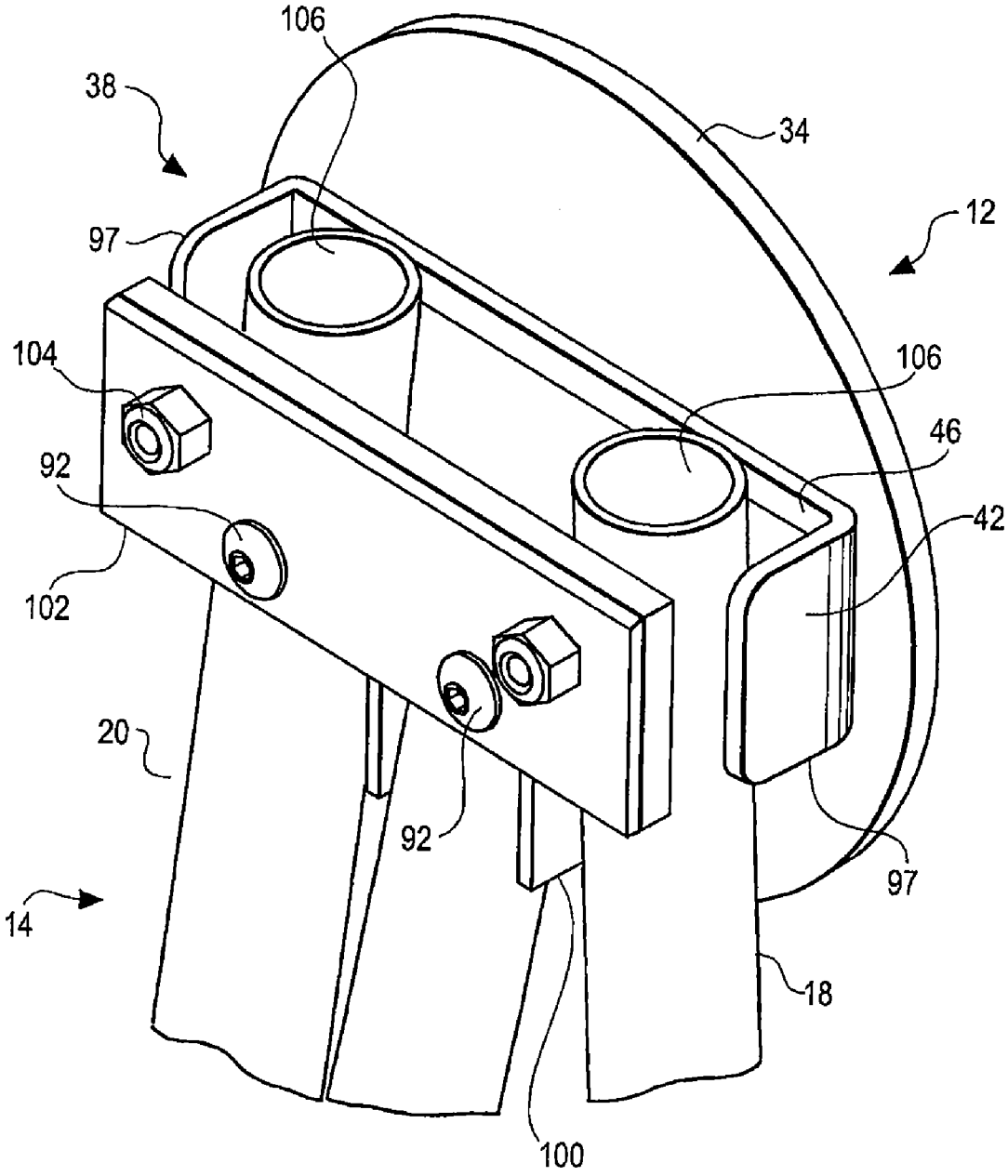
FIG. 2 is a rear detail perspective view of the top of the collapsible easel of FIG. 1.
Figure 3:
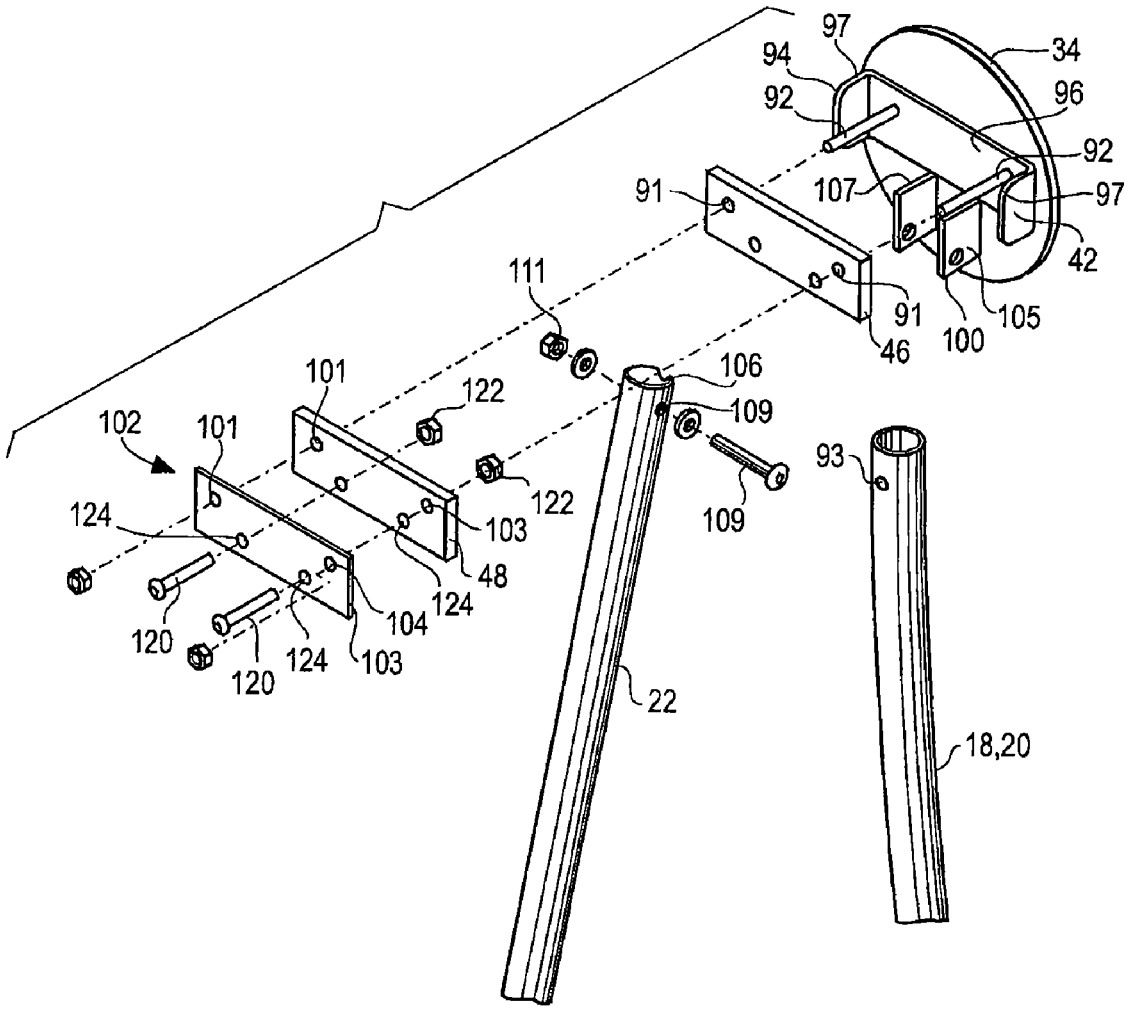
FIG. 3 is a rear detail exploded view of the top of the collapsible easel shown in FIG. 2.

As seen in FIG. 2, top assembly 12 of the easel 10 comprises a front support 34 and a connector assembly 38. Front support 34 is mounted on the base 14 to provide upper support for display panels, canvases, sketchbooks, flip charts or the like placed on any pair of bracket members 24, 26, 28 of the base 14. In FIGS. 1, 2 and 3, front support 34 is a circular disk. However, such design should not be considered limiting and other shapes can be adopted for the front support 34.

As seen in FIGS. 2 and 3, connector assembly 38 comprises a front connector 42 and a back connector 102. Front connector 42 comprises a bracket assembly 94 permanently attached to the back side of the front support 34, and a first cushion member 46 fitted between the bracket assembly 94 and top ends 106 of front legs 18, 20.

Referring to FIG. 3, bracket assembly 94 includes a first plate 96 with side members 97 extending orthogonally from first plate 96, and two externally threaded tubes 92 each secured to and also extending orthogonally from first plate 96. Cushion member 46 includes a pair of apertures 91 through which threaded tubes 92 extend to hold the cushion member adjacent first plate 96.

Referring to FIGS. 2 and 3, externally threaded tubes 92 also extend through aligned apertures 93 at the top 106 of front legs 18, 20 to pivotally hold legs 18, 20 to connector assembly 38. The tops 106 of legs 18, 20 are spaced a short distance from outwardly extending side members 97, such that the accurate distance legs 18, 20 can move outwardly about tubes 92 is limited when legs 18, 20 contact side members 97. Also, cushion members 46, 48 apply a slight retard or drag force on legs 18 and 20 as the legs pivot on tubes 92 when the easel 10 is folded or opened.

Back connector assembly 102 comprises a back plate 104 and second cushion member 48, wherein both back plate 104 and second cushion member 48 include apertures 101, 103 adapted to receive externally threaded tubes 92 after the tubes extend through the top ends 106 of front legs 18, 20. Legs 18, 20 are firmly but pivotally held between cushion member 46 and cushion member 48. Back plate 104 and second cushion member 48 are held together by a pair of bolts 120 and nuts 122 extending through aligned apertures 124 in both the back plate and the second cushion member.

Cushions 46, 48 are made of elastic or soft materials and are fitted in between the connector assembly 38 and the legs 18, 20 to reduce friction and wear resulting from physical contact caused by pivotal movement of the legs abutting the connector assembly 38.

The bracket assembly 94 further comprises a second plate portion 100 with apeltured flanges 105, 107 adapted to receive the rear leg 22 between the flanges. The rear leg 22 is pivotally mounted to flanges 105, 107 on a bolt 109 that extends through the apertures in both flanges 105, 107 and through a pair of aligned apertures 109 in the top of rear leg 22. A nut 111 securely holds leg 22 to edges 97. The rear leg 22 is also pivotally attached to bolt 109, and pivots at a slight drag when V-spring assembly 32 is detached.

In operation, the user places the easel 10 on the ground, floor or other surface and arranges the legs 18, 20 and 22 such that the easel 10 is in the tripod configuration 110 shown in FIG. 1. The user then locks the legs 18, 20, 22 of the easel 10 in place by means of V-shaped spring 72. The user pinches or squeezes on the two ends 74, 76 of the V-shaped spring 72 toward each other and inserts ends 74 and 76 into the respective apertures 78, 84 on the front legs 18, 20. V-shaped spring 72 (FIG. 5) pivots in bracket 80 until ends 74, 76 are properly aligned with and inserted in apertures 78, 84. The user then unfolds a pair of opposed bracket members 24, 26, 28 to the outward position 114, and places a display panel, canvas, sketch book, flip chart or the like on the brackets behind vertical extensions 70 of the extending brackets. After use, the user removes the canvas, sketchbook, flip chart or the like from the opposed pair of bracket members, folds up each bracket member (FIG. 6), and detaches the spring assembly 32 by pressing ends 74, 76 of the V-shaped spring 72 toward each other and removing the ends 74, 76 of the spring assembly 32 from apertures 78, 84 (FIG. 7). The legs 18, 20, 22 are pivotally moved toward each other to the folded configuration 112 (FIG. 7), and may be clasped or tied to reduce the space needed for storage and transportation of the easel 10.

Figure 8:
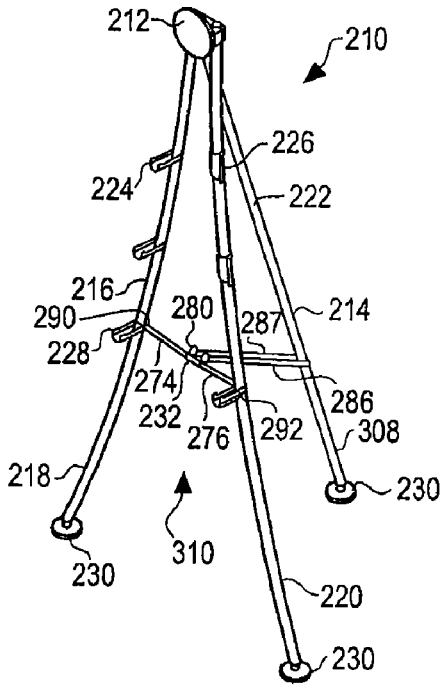
FIG. 8 is a front/side perspective view of another embodiment of the present invention, wherein the V-shaped spring assembly is replaced with a collapsible brace assembly to selectively allow the legs of the easel to be maintained in either an expanded position or a collapsed position.
Figure 9:
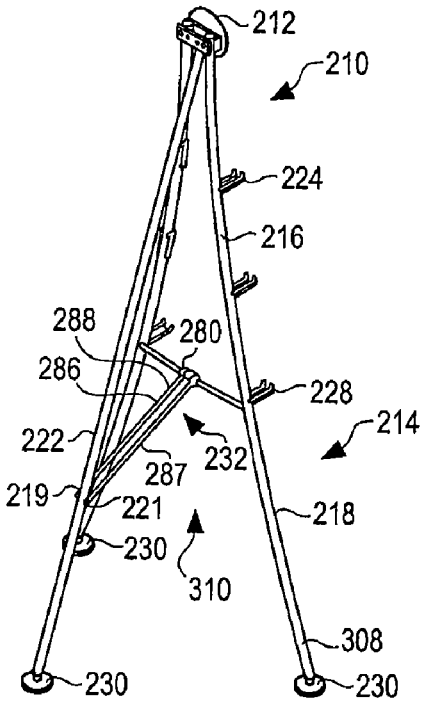
FIG. 9 is a rear/side perspective view of the collapsible easel of FIG. 8.
Figure 10:
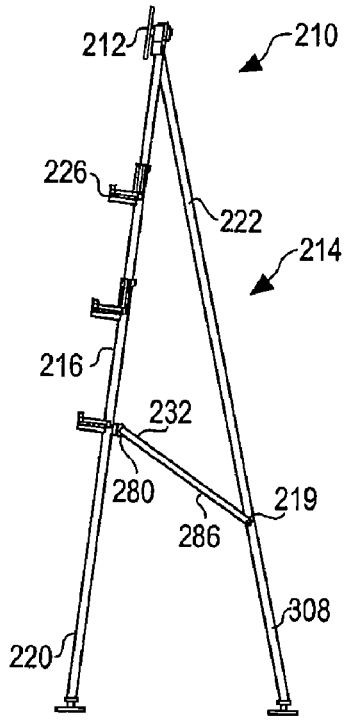
FIG. 10 is a side elevation view of the collapsible easel of FIG. 8.

FIGS. 8-10 illustrate a second embodiment of the collapsible easel 210 also having a top assembly 212 and a base 214. The base 214 includes a front leg assembly 216 and a rear leg 222. The front leg assembly comprises a first front leg 218 and a second front leg 220. Both of the front legs 218, 220 and the rear leg 222 are pivotally attached to top assembly 212, as previously described with reference to the first embodiment. The structure of the front legs 218 and 220, and the rear leg 222 is similar to that described for the first embodiment.

Each of the legs 218, 220, 222 in the illustrated second embodiment is provided with a footing 230, which is attached through conventional means to the bottom end 308 of each of the legs 218, 220, 222 for safety and stability considerations.

As seen in FIGS. 8-10, when the easel 210 is in use, legs 218, 220 and 222 form a triangle, or tripod, where footings 230 contact the surface supporting easel 210, thus allowing easel 210 to stand in tripod configuration designated 310. When collapsing the easel 210, legs 218, 220 and 222 are each pivotally moved towards each other and folded adjacent one another to a folded configuration designated 212 (FIG. 11), allowing for easy transportation and storage of the easel 210.

As seen in FIGS. 8-10, each of the front legs 218, 220 is provided with a plurality of pivotally attached bracket members such as 224, 226 and 228. Each bracket member has a structure, function, and orientation which is similar to that previously described for the first embodiment.

Figure 13:
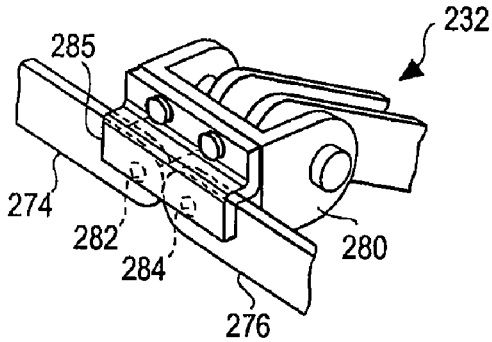
FIG. 13 is a rear detail perspective view of the center bracket, lateral struts, and rear strut assembly forming part of the collapsible brace assembly of the collapsible easel of FIG. 8.

As seen in FIGS. 8-10, a collapsible brace assembly 232 comprises a pair of lateral struts 274, 276 extending between and pivotally attached to each of the front legs 218, 220. Each lateral strut 274, 276 is also pivotally connected to a center bracket 280 at pivot points 282 and 284 as shown in FIG. 13. The lateral struts 274, 276 are pivotally connected to each front leg 218, 220 at 290 and 292 and to the center bracket 280 by pivot mechanisms well-known in the art such as bolts, screws, washers, and the like. The center bracket 280 is also pivotally attached to a rear strut assembly 286 which extends to, and is pivotally connected to the rear leg.

In the illustrated embodiment as shown in FIGS. 8-10, the rear strut assembly 286 further comprises a pair of rear struts 287, 288 extending in parallel to the rear leg of the easel and pivotally connected to the rear leg 222 at diametrically opposed surfaces 219, 221 of the rear leg 222. The rear strut assembly is pivotally connected to the rear leg 222, and to the center bracket 280, by mechanisms well-known in the art such as bolts, screws, washers, and the like.

Figure 12:
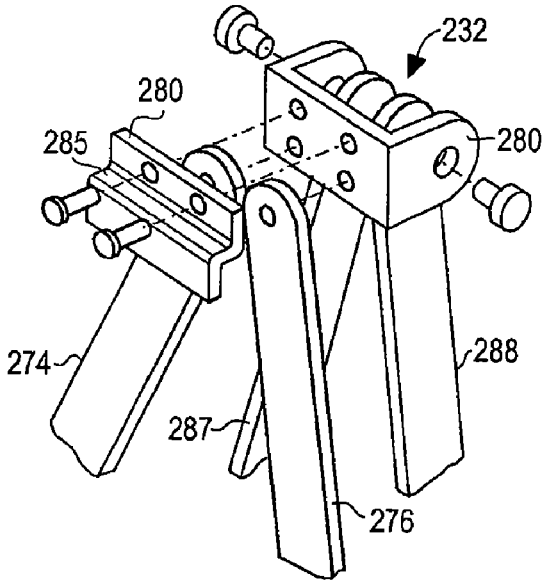
FIG. 12 is an exploded detail perspective view of the center bracket, lateral struts, and rear strut assembly forming part of the collapsible brace assembly of the collapsible easel of FIG. 8.

As shown in FIGS. 12 and 13, flange 285 extends outward and downward over the lateral struts 274, 276 when the struts 274, 276 are extended between the front legs 218, 220. When the lateral struts 274, 276 are fully extended outwardly from center bracket 280, the flange 285 maintains the struts 274, 276 in a slightly over-center position (FIG. 8) to maximize support for the easel. The flange 285 limits the rotative movement of struts 274, 276, provides direct support for the lateral struts and the front legs 218, 220 when the easel 210 is in the first open tripod position, and provides support for the entire collapsible brace assembly 232 while the easel is in use.

Figure 11:
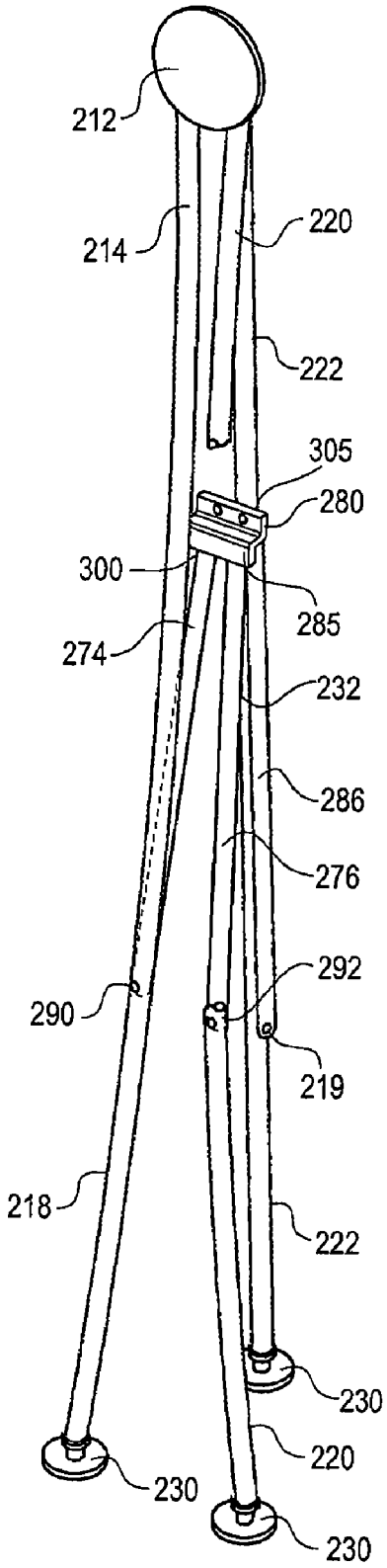
FIG. 11 is a view of the collapsible easel of FIG. 8, shown in the substantially folded or collapsed position.

The dimensions of the lateral cross struts 274, 276 and the rear strut 286 are determined by the first open position and the second closed or collapsed position for the easel. When the easel is collapsed, the lateral struts 274, 276 are folded upward against the two front legs 218, 220 such that a new vertical dimension is reached at 300 (FIG. 11) which is substantially equal to the length of each the lateral struts 274, 276. Respectively, the rear strut 286 is folded upward through the center of the easel to a new vertical dimension 305 (FIG. 11) which is also equal to the length of the rear strut 286. The approximate dimensions here are selected to allow the easel to be collapsed to a flat position as shown in FIG. 11, where the collapsible brace assembly 232 abuts up against the legs in the folded position without any protrusion beyond the perimeter created by the folded legs of the easel. In the illustrated embodiment of FIG. 8, as an example, this function is empirically achieved by creating an easel wherein the lateral struts 274, 276 each have a length of approximately 7 inches and the rear strut has a length of approximately 17¾ inches. Additionally, when the easel is in the open tripod position, the rear strut is located approximately 30½ inches upward from ground level on the rear leg and the collapsible brace assembly is located approximately 44¾ inches from the top assembly on each of the front legs.

Collapsible brace assembly 232 provides stable positioning of the easel 210 by enabling the front legs 218, 220 and the rear leg 222 to pivotally extend to an open, locked tripod position such that the legs will be immobile relative to each other when the easel is in use. After use, an upward force is applied to the center bracket 280 in an upward direction opposite the footings 230 of the easel, and each of the legs pivot toward each other at a light drag, allowing the easel to be easily collapsed to the folded configuration 212. (FIG. 11)

As seen in FIG. 11, top assembly 212 comprises a front support 234 and a connector assembly 238. The structure and function of the front support 234 and the connector assembly 238 is similar to that previously described for the first embodiment of the collapsible easel.

In operation, the user places the easel 210 on the ground, floor or other surface and arranges the legs 218, 220 and 222 in such a way that the easel 10 is in the tripod configuration as shown in FIG. 8. The user then locks the legs 218, 220, 222 of the easel 210 in place by moving the brace assembly 232 to the position shown in FIG. 8. The user presses downward on the collapsible brace assembly 232 until the lateral struts 274, 276 are horizontally extended between the front legs 218, 220 and supported by flange 285 in a slightly over-center position, and the rear strut 286 is fully extended to the rear leg at an approximately 45 degree angle relative to the lateral struts. The user then unfolds a pair of bracket members 224, 226, 228 to the outward position 214, and places a display panel, canvas, sketch book, flip chart or the like on the brackets behind vertical extensions of flanges 270. After use, the user removes the canvas, sketchbook, flip chart or the like from the pair of bracket members, folds up the pair of bracket members (as previously shown in FIG. 6), and folds the collapsible brace assembly 232 by pushing the center bracket 280 in an upward direction. The legs 218, 220, 222 are pivotally moved together to the folded configuration 212 (FIG. 11), and may be clasped or tied if necessary to ensure the easel remains in the folded position and to reduce the space needed for storage and transportation of the easel 210.

With respect to the above description herein, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing detailed description of the invention is intended to be illustrative and not intended to limit the scope of the invention. Changes and modifications are possible with respect to the foregoing description, and it is understood that the invention may be practiced otherwise than that specifically described herein and still be within the scope of the invention.

What is claimed is:

1. A collapsible easel comprising:

a top assembly;

a base comprising a front leg assembly pivotally connected to said top assembly, and a rear leg pivotally connected to said top assembly;

said front leg assembly comprising two front legs, each leg independently pivotally connected to said top assembly;

a brace assembly pivotally attached at one end to a fixed point on said rear leg, said brace assembly also removably engaging each of said two front legs, said brace assembly permitting movement of said front legs away from each other and towards each other when said brace assembly is removed from engagement with said two front legs;

said brace assembly securing said front and rear legs in a tripod configuration when said brace assembly engages said two front legs; and said brace assembly permitting said front and rear legs to be maintained in a collapsed position when said brace assembly is disengaged from said two front legs.

2. A collapsible easel comprising:

a top assembly;

a base comprising a front leg assembly pivotally connected to said top assembly, and a rear leg pivotally connected to said top assembly;

said front leg assembly comprising two front legs, each leg independently pivotally connected to said top assembly;

a brace assembly pivotally attached at one end to a fixed point on said rear leg, said brace assembly also moveably engaging each of said two front legs, said brace assembly permitting movement of said front legs away from each other in a first position of the brace assembly and towards each other in a second position of said brace assembly;

said brace assembly securing said front and rear legs in a tripod configuration when said brace assembly is in said first position;

said brace assembly permitting said front and rear legs to be maintained in a collapsed position when said brace assembly is in said second position;

said brace assembly comprising a V-shaped spring assembly adapted to removably connect said rear leg to said front leg assembly, said V-shaped spring assembly comprising a V-shaped spring having a first and a second end, each end removably attached to said first and second front leg respectively, said V-shaped spring including a bottom center portion, said bottom center portion pivotally attached to said fixed point on said rear leg.

3. The collapsible easel of claim 2 including an attachment bracket pivotally attached to said V-shaped spring at the bottom center portion of said V-shaped spring, said bracket pivotally mounting said V-shaped spring to said rear leg at said fixed point.

4. A collapsible easel comprising:

a top assembly;

a base comprising a front leg assembly pivotally connected to said top assembly and a rear leg pivotally connected to said top assembly;

said front leg assembly comprising two front legs, each leg independently pivotally connected to said top assembly;

a brace assembly pivotally attached at one end to said rear leg, said brace assembly also removably engaging each of said two front legs, said brace assembly permitting movement of said front legs away from each other in a first position of the brace assembly and towards each other in a second position of said brace assembly when said brace assembly is removed from engagement with said two front legs;

said brace assembly securing said front and rear legs in a tripod configuration when said brace assembly engages said two front legs;

said brace assembly permitting said front and rear legs to be maintained in a collapsed position when said brace assembly disengages from said two front legs;

the top assembly comprising a front support adapted to support the rear of an item to be displayed, and a connector assembly including a front connector and a back connector, the connector assembly pivotally connecting said base to said top assembly;

the front connector including a bracket assembly and a first cushion member, the back connector including a back plate and a second cushion member, said first cushion member being located between said bracket assembly and said base, and said second cushion member being located between said back plate and said base, said first and second cushion members applying a drag force on said two front legs as said two front legs pivot from said top assembly.

5. The collapsible easel of claim 4, wherein the bracket assembly comprises a first and a second plate, said front leg assembly pivotally attached to said first plate, and said rear leg pivotally attached to said second plate.

6. The collapsible easel of claim 1, wherein, said top assembly includes a front support and a connector assembly, said connector assembly including at least one cushion member;

said at least one cushion member directly and continuously frictionally engaging said two front legs and applying a drag force resisting movement during movement of said two front legs.

7. The collapsible easel of claim 1, wherein said brace assembly comprises a collapsible brace connecting said rear leg to said front leg assembly, said collapsible brace assembly comprising a pair of lateral struts extending between and engaging each of the front legs, and a bracket connecting the lateral struts, the bracket further engaging a rear extension assembly that extends to and is pivotally connected to said fixed point of the rear leg.

8. The collapsible easel of claim 7 wherein the rear extension assembly comprises at least two rear struts extending in parallel to the rear leg of the easel and pivotally connecting to the fixed point of the rear leg at diametrically opposed surfaces of the rear leg.

9. The collapsible easel of claim 7 having a first position wherein the front leg assembly and the rear leg generally form a triangle shape allowing said easel to be positioned in a first tripod position, and a second position wherein said front leg assembly and said rear leg are collapsed towards each other to a folded configuration.

10. The collapsible easel of claim 9 wherein the length of each of the pair of lateral struts and the rear extension assembly is determined by the first and second positions of the easel and to allow the easel to be folded with all legs closely adjacent to each other.

11. The collapsible easel of claim 7 wherein each lateral strut is pivotally connected to the bracket of the brace assembly, and each lateral strut is adapted to be rotated at said bracket in an upward direction for collapsing the easel to the second position and rotated in a downward direction for expanding the easel to the first open tripod position.

12. The collapsible easel of claim 7 wherein the rear extension assembly is pivotally connected to the bracket of the brace assembly, and the rear extension assembly is adapted to facilitate upward motion of the brace assembly for collapsing the easel to the second position and downward motion for expanding the easel to the first open tripod position.

* * * * *